US006081777A

United States Patent [19]

Grabb

[11] Patent Number: 6,081,777

[45] Date of Patent: Jun. 27, 2000

[54] ENHANCEMENT OF SPEECH SIGNALS TRANSMITTED OVER A VOCODER CHANNEL

[75] Inventor: Mark Lewis Grabb, Burnt Hills, N.Y.

[73] Assignee: Lockheed Martin Corporation, King of Prussia, Pa.

[21] Appl. No.: 09/157,445

[22] Filed: Sep. 21, 1998

[51] Int. Cl.[7] ..... G10L 19/02

[52] U.S. Cl. ..... 704/220; 704/207; 704/205; 704/228

[58] Field of Search ..... 704/209, 224, 704/225, 226, 227, 228, 205, 207, 500, 501, 220

[56] References Cited

U.S. PATENT DOCUMENTS 3,624,302 11/1971 Atal ..... 704/206
5,696,875 12/1997 Pan et al. ..... 704/219

OTHER PUBLICATIONS

Bernard Sklar, Digital Communications Fundamentals and Applications, pp. 15–16, 29–30, 650–652, Oct. 1987.
Herbert Taub, Principles of Communication Systems, pp. 120–121, Jan. 1986.

*Primary Examiner*—Richemond Dorvil
*Assistant Examiner*—Abul K. Azad
*Attorney, Agent, or Firm*—W. H. Meise

[57] ABSTRACT

In a vocoder system, the receiver is arranged to emphasize at least the fundamental or lowest-frequency sinusoidal signal in response to the pitch, in a manner which provides more emphasis at lower pitch values, corresponding to larger pitch intervals. The emphasis provides a subjectively improved speech synthesis. In a preferred embodiment, the enhancement takes place at fundamental component frequencies below 400 Hz. According to another aspect of the invention, the second and third harmonics are also emphasized, but generally not as much as the fundamental component. Below certain frequencies, the enhancement is limited for the fundamental and the harmonics.

6 Claims, 3 Drawing Sheets

ENHANCEMENT OF SPEECH SIGNALS TRANSMITTED OVER A VOCODER CHANNEL

FIELD OF THE INVENTION

This invention relates to transmission of speech signals using a vocoder, and more particularly to arrangements and methods for improving the perceived quality of such transmissions.

BACKGROUND OF THE INVENTION

There is always a need for more bandwidth in communications channels, to accommodate a larger number of users. The finite or limited availability of channel bandwidth, in turn, makes the efficient use of bandwidth an economic necessity. The transmission of speech signals over limited-bandwidth channels has been the subject of extensive investigation and improvement. These improvements have given rise to devices known in the art as vocoders. In general, vocoders include a transmitter which analyzes the voice signal to be transmitted, and extracts various characteristics of the speech. These characteristics are encoded in some fashion, and transmitted over the limited-bandwidth transmission channel to a vocoder receiver. The vocoder receiver receives the encoded signals, and reconstitutes the original voice signal.

The voice signals which are reconstituted by the vocoder receiver never include all of the information occurring in the original voice signal, because the bandwidth of the transmission channel is incapable of carrying all of the information in the original voice. Thus, the quality of the signal received at the output of a vocoder system depends in part upon the bandwidth of the channel over which the signal must be transmitted, and in part upon the efficiency with which the system analyzes and reconstitutes the voice.

Of necessity, there is a certain amount of distortion in transmission over a vocoder system, and this distortion is manifested as coding noise. Various schemes have been advanced for masking or reducing the perceived amplitude of the coding noise. Among these schemes are those described in U.S. patent applications filed on Jul. 13, 1998, Ser. No. 09/114,658 in the name of Grabb et al.; Ser. No. 09/114,660 in the name of Zinser et al.; Ser. No. 09/114,661 in the name of Zinser et al. Ser. No. 09/114,662 in the name of Grabb et al.; Ser. No. 09/114,663 in the name of Zinser et al.; Ser. No. 09/114,664, in the name of Zinser et al.; and Ser. No. 09/114,659 in the name of Grabb et al., in which the amplitudes of the fundamental and its harmonics in the synthesized signal are increased or decreased in amplitude in response to the pole frequencies of the linear predictive coding (LPC) filter. In this arrangement, the general shape of the frequency spectrum represented by the coded signals remains the same, but the amplitude spread between the maximum-amplitude and minimum-amplitude components is adjusted (either increased or decreased).

Improved vocoder arrangements are desired.

SUMMARY OF THE INVENTION

According to an aspect of the invention, the vocoder receiver of a vocoder arrangement emphasizes at least the fundamental or lowest-frequency sinusoidal signal in response to the pitch, in a manner which provides more emphasis at lower pitch values, corresponding to larger pitch intervals. The emphasis provides a subjectively improved speech synthesis. In a preferred embodiment, the enhancement takes place at fundamental component frequencies below 400 Hz. According to another aspect of the invention, the second and third harmonics are also emphasized, but generally not as much as the fundamental component. Below certain frequencies, the enhancement is limited for the fundamental and the harmonics.

More particularly, vocoder system according to an aspect of the invention receives coded speech signals over a limited-bandwidth channel. The coded speech signals include components representing the spectrum, gain, and voicing of the original speech signals. The coded speech signals also include signal components representing pitch of the original speech signals. The vocoder system includes a synthesizer arrangement coupled to the output of the limited-bandwidth channel for generating synthesized fundamental frequency signals, and harmonics of the synthesized fundamental frequency signals, in response to at least spectrum, gain, and voicing signals. The vocoder system also includes an arrangement for selecting the relative amplitude of at least the fundamental frequency component of the synthesized signal in response to the pitch period of the fundamental frequency, in such a manner that the fundamental frequency component is increased in amplitude relative to at least some components which are higher-frequency harmonics of the fundamental frequency, in inverse relationship to the fundamental frequency.

In a particularly advantageous version of the invention, the vocoder system further includes an arrangement for selecting the relative amplitude of at least the second harmonic of the fundamental frequency of the spectrum in response to the pitch period of the fundamental frequency, in such a manner that lower pitch second-harmonic frequencies are increased in amplitude relative to at least some higher-frequency harmonics of the fundamental frequency than the second harmonic.

In another embodiment of the invention, the same structure acts on both the fundamental component of the synthesized signal, and the second harmonic of the fundamental. In a preferred embodiment, the structure acts on the fundamental component of the synthesized signal, and on its second and third harmonics.

DESCRIPTION OF THE INVENTION

Figure 1:
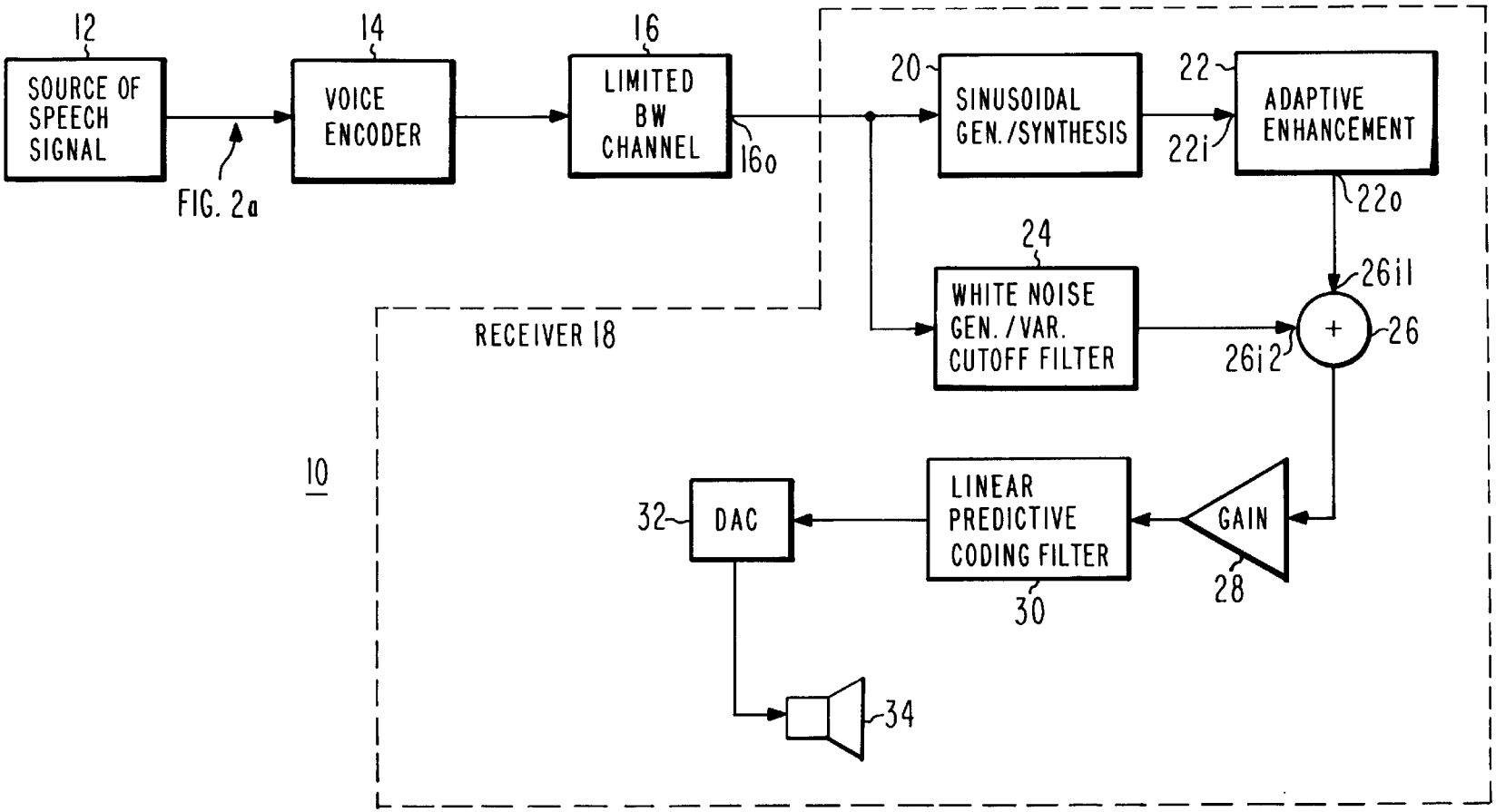
FIG. 1 is a simplified block diagram illustrating a vocoder system according to an aspect of the invention, for transmitting signals over a limited-bandwidth channel, and for reconstituting the signals so transmitted in accordance with an aspect of the invention.
Figure 2:
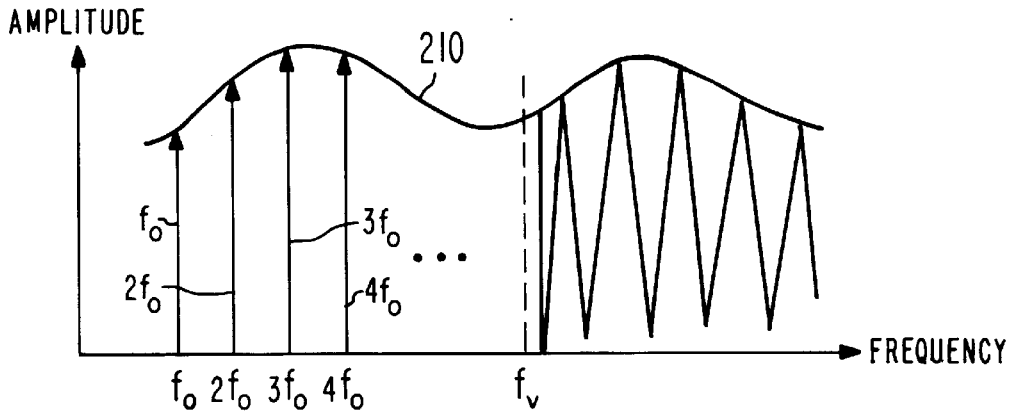
FIG. 2 is a simplified representation of the frequency spectrum of a speech signal.

FIG. 1 illustrates a speech transmission or vocoder system 10. While FIG. 1 is in block-diagram form, those skilled in the art will recognize that this is but one way to illustrate a device, and that some of the functions illustrated as being performed by dedicated blocks may preferably be performed by software-programmed processors. In FIG. 1, system 10 includes a source 12 of speech signals, which may include a microphone, record playback apparatus, or the like, which applies speech signals to a voice encoder 12. FIG. 2 illustrates the frequency spectrum of a typical speech or voice signal as applied to voice encoder 12. In FIG. 2, the speech signal has an amplitude envelope or spectrum 210, which defines the amplitude limits of the various frequencies within the signal. At frequencies below a voicing frequency $f_V$, the speech signal of FIG. 2 includes a fundamental sinusoidal component at a frequency $f_0$, which is also identified as component $f_0$; this designation allows the "name" which identifies the speech component to also identify its frequency. In addition to fundamental speech frequency component $f_0$, the speech signal of FIG. 2 also includes additional sinusoidal components, of which three are illustrated, which are denominated $2f_0$, $3f_0$, and $4f_0$. A given speech signal may include few or many such harmonics of the fundamental component $f_0$. Above a voicing frequency identified as $f_V$ in FIG. 2, the speech sound takes on noise-like characteristics, rather than the characteristics of sinusoidal frequency components, as illustrated for the region below the voicing frequency.

Voice encoder 14 of FIG. 1 digitizes the speech signals illustrated in FIG. 2, and encodes the speech signals by generating digital signals representing voicing, spectrum, gain and pitch (or more properly pitch period). The encoded signals are transmitted over a signal path illustrated as a block 16. Signal path 16 may be of any form, and may include a land line or photonic link (such as an optical fiber cable), but is more likely to include an electromagnetic transmission path such as a radio link, because the land lines or photonic paths often have relatively wide bandwidths.

At the output end of signal path or channel 16 of FIG. 1, the coded signals are applied to a receiver designated generally as 18. Within receiver 18, the signals are applied in parallel or simultaneously to a sinusoidal signal generator 20 and to a variable-frequency-cutoff white noise generator 22. Sinusoidal signal generator or synthesizer 20 responds to at least the pitch component of the coded signals to produce a fundamental signal $f_0$, which should be at least similar to the corresponding original speech component of FIG. 2. Sinusoidal signal generator or synthesizer 20 also generates harmonics of synthesized signal component $f_0$, namely the second harmonic at frequency $2f_0$, the third harmonic at $3f_0$, and possibly other harmonic components, one of which is illustrated as $4f_0$.

Sinusoidal generator or synthesizer 20 is not required to generate sinusoidal signals at frequencies lying above voicing frequency $f_V$, because the speech components above $f_V$ are in the form of noise, rather than in the form of sinusoidal components. For this reason, generator or synthesizer 20 may be responsive to the coded voicing signals to cut off the generation of sinusoidal signals at frequencies above the voicing frequency. The sinusoidal signals produced by generator or synthesizer 20 are applied by way of an adaptive enhancement block 22 to a noninverting input port **26*i*1 of a summing circuit 26**.

It should be noted that the standard phraseology for discussions of fundamental frequencies and their harmonics is subject to some ambiguities, in that the description of harmonics assumes that the fundamental frequency is the first harmonic. Thus, if both "fundamental" and "second harmonic" components are discussed in relation to the same matter, there can be no such thing in that description as a "first" harmonic component, since that has already been described in the alternative language as the "fundamental."

White noise generator 24 of FIG. 1 produces white noise at frequencies above a cutoff frequency, which cutoff frequency is responsive to the voicing signal $f_V$. In most such arrangements, the cutoff frequency is controlled in a stepwise fashion, rather than in a continuous fashion, because stepwise control requires less bandwidth than continuous control. The white noise signals at the output of white noise generator 24 are applied to a second noninverting input port **26*i*2 of summing circuit 26. Summing circuit 26 sums the sinusoidal signal components $f_0$ and those harmonics $2f_0$, $3f_0$, $4f_0$ . . . which are generated by generator or synthesizer 20** with the white noise signals lying above frequency $f_V$, to produce a synthesized replica of the original speech signal.

The volume or signal amplitude of the current value of the synthesized signal produced by the summing circuit 26 of FIG. 1 is controlled by a gain element, illustrated by an amplifier symbol designated 28. Gain element 28 is responsive to the gain component of the coded signals. The gain-controlled synthesized signals are applied to a linear predictive coding filter 30, known in the art, for producing the final synthesized equivalent of the original speech signal. The coding filter applies the overall amplitude/frequency shape, equivalent to envelope 210 of FIG. 2, to the gain-controlled sum of the sinusoidal and noise speech components. The final synthesized equivalent of the speech signal is converted to analog form, if desired, by a digital-to-analog converter (DAC) 32, and applied to a utilization device, illustrated as a symbolic loudspeaker 34.

Figure 3:
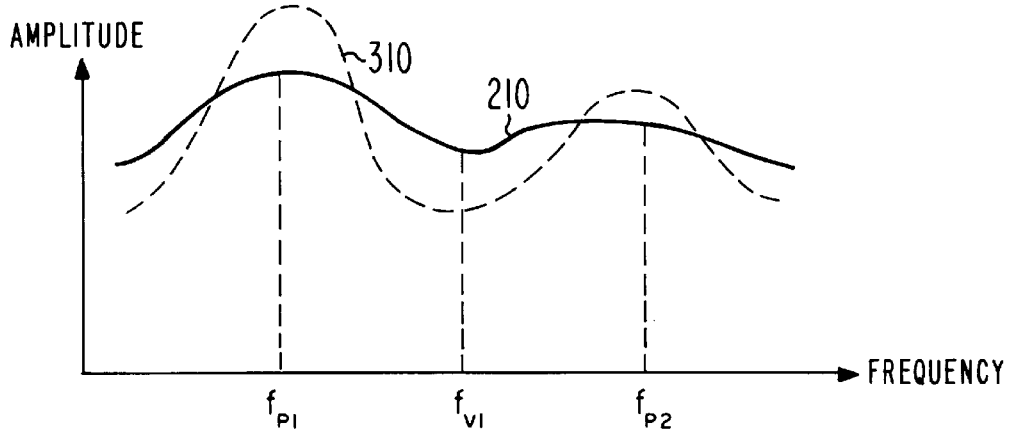
FIG. 3 is a simplified representation of the envelope of the frequency spectrum of a synthesized speech signal as described in the abovementioned Grabb et al. and Zinser et al. applications.

In FIG. 3, the envelope plot 210 of FIG. 2 is repeated for ease of understanding, and certain frequencies associated with the shape of the envelope plot are identified. In particular, the frequencies of the centers of two peaks are identified as $f_{P1}$ and $f_{P2}$, and the frequency of the center of the valley lying therebetween is designated as $f_{V1}$. Note that the meaning of valley frequency $f_{V1}$, differs from the meaning of voicing frequency $f_V$, and there is no necessary coincidence between the two values. As described above in relation to some of the Grabb et al. and Zinser et al. patent applications, the described technique for the purpose of controlling the spectrum of the synthesized speech at the vocoder receiver involves adjusting the linear predictive coding in the manner suggested by the dashed line 310 in FIG. 3. More particularly, the amplitudes of the signal are relatively increased at frequencies corresponding to the peaks, namely at frequencies $f_{P1}$ and $f_{P2}$, and relatively decreased at the valley frequency $f_{V1}$.

It has been discovered that a subjective improvement in overall transmission quality occurs when at least the fundamental sinusoidal component $f_0$ is increased in amplitude relative to high harmonics of the sinusoidal signal or relative to the noise components above frequency $f_V$, in response to the pitch, or more properly, in response to the pitch interval. The relationship between pitch interval $T_p$ (the interval between successive glottal stops) and fundamental frequency is $f_0=1/T_p$. More particularly, it has been found that this subjective improvement in quality occurs, regardless of the bandwidth of the channel, and regardless of the ratio of the channel bandwidth to the bandwidth of the original speech signal, if the amplitude of the fundamental sinusoidal component $f_0$ is increased inversely in response to the frequency, or in response to the pitch interval, so that, as between two synthesized signals which have different fundamental frequencies but which are otherwise identical, that one having the lower fundamental frequency has the larger fundamental amplitude. It is not necessary that the increase in amplitude be in direct relation (in proportion) to the value of fundamental frequency for the improvement in quality to be perceived. An even greater improvement appears if the second harmonic is also increased in amplitude, and additionally if the third harmonic is increased in amplitude. There is no need for the increase in amplitudes of the fundamental, second harmonic and third harmonic components to be identical.

Figure 4:
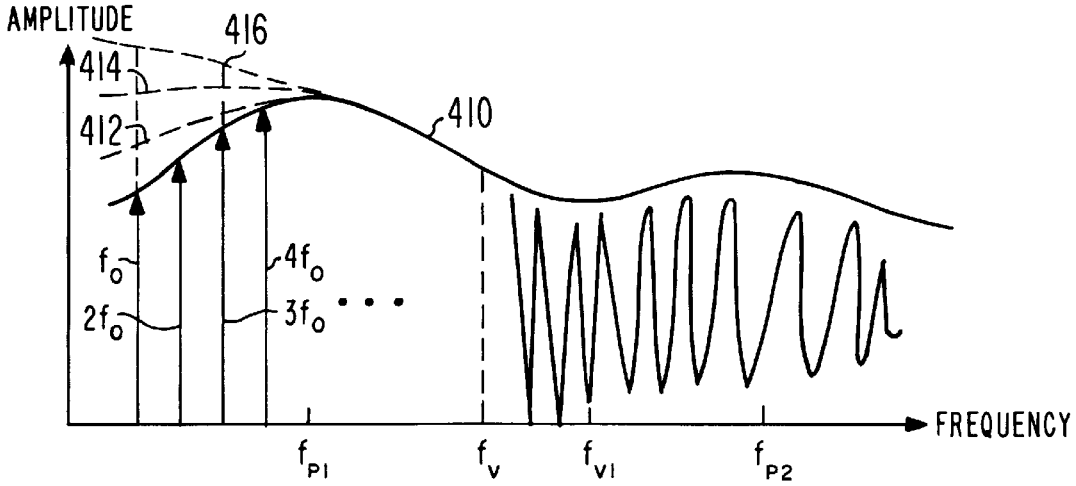
FIG. 4 is a simplified representation of various envelopes of the frequency spectrum of a synthesized speech signal according to an aspect of the invention.

According to an aspect of the invention, the fundamental sinusoidal component, and the amplitudes of the second and third harmonics of the fundamental sinusoidal component, are changed in amplitude in inverse response to the frequency of the fundamental component, so as to be increased in amplitude (relative to sinusoidal components at higher frequencies or relative to the noise components) when the fundamental frequency decreases (when the pitch increases), and so as to decrease in amplitude (relative to sinusoidal components at higher frequencies or relative to the noise components) when the fundamental frequency increases (pitch decreases). FIG. 4 illustrates a synthesized speech signal having an envelope 410, fundamental frequency component $f_0$, and second, third and fourth harmonic components $2f_0$, $3f_0$, $4f_0$, and possibly other components. As illustrated in FIG. 4, the fundamental frequency component $f_0$ lies on a portion of envelope 410 having a positive slope, and the harmonic components $2f_0$, $3f_0$, and $4f_0$ are also illustrated as lying on a portion of positive slope. As a consequence, sinusoidal components of the synthesized signal at frequencies $f_0$, $2f_0$, $3f_0$, $4f_0$ have amplitude relationships which are determined by the envelope 410. Thus, fourth harmonic component $4f_0$ is larger than third harmonic component $3f_0$, third harmonic component $3f_0$ is larger than second harmonic component $2f_0$, and second harmonic component $2f_0$ is larger than fundamental sinusoidal component $f_0$. Several possible responses in accordance with the invention are illustrated. More particularly, the envelope illustrated by dot-dash-dot line 412 raises the amplitudes of fundamental component $f_0$ and harmonic components $2f_0$, and $3f_0$, without having much effect on the amplitude of the harmonic component at $4f_0$. After increasing the amplitudes of various signal components pursuant to envelope 412, the amplitudes of the various components are still in the same relationship as with original envelope 410, namely that fundamental component $f_0$ is still the smallest, and the harmonic component $4f_0$ is still the largest. Similarly, the envelope illustrated by dot-dash line 414 raises the amplitudes of fundamental component $f_0$ and harmonic components $2f_0$, and $3f_0$, with some effect on the amplitude of the harmonic component at $4f_0$. After increasing the amplitudes of various signal components pursuant to envelope 414, the amplitudes of the various components are in a different relationship than was the case with original envelope 410. In the case of envelope 414, the fundamental component $f_0$ has about the same amplitude as the remaining harmonic components $2f_0$, $3f_0$, and $4f_0$. For completeness, the envelope illustrated by dash line 416 raises the amplitudes of fundamental component $f_0$ and harmonic components $2f_0$, $3f_0$, and $4f_0$. After increasing the amplitudes of various signal components pursuant to envelope 416, the amplitudes of the various components are in a relationship which is the opposite to that of the original envelope 410. In the case of envelope 416, the fundamental component $f_0$ is the largest of the four components $f_0$, $2f_0$, $3f_0$, and $4f_0$, and their amplitudes decrease with increasing frequency. It should be noted that in all the cases represented by envelopes 412, 414, and 416, the amplitude of the fundamental component $f_0$ is being increased by comparison with those harmonic components lying at frequencies above that of $4f_0$, and by comparison with the amplitudes of all components lying above first peak frequency $f_{P1}$. The envelope plot illustrated as 412 would be applied in the case of a particular frequency of fundamental component $f_0$, which we can call $f_{412}$, the plot illustrated as 416 would be applied for the lowest frequency of fundamental component $f_0$, which we can call $f_{416}$, and the plot illustrated as 414 would be applied for a frequency of the fundamental component lying between $f_{412}$ and $f_{416}$ Thus, it can be seen that the boost of the low-frequency components fundamental and lowest-frequency components is largest for the lowest-frequency fundamental components, and least for those fundamental components which are at the high end of a band of frequencies.

Control of the relative amplitude of the sinusoidal fundamental component and of the sinusoidal second and third harmonics is performed in adaptive enhancement block 22 of FIG. 1. It must be recognized that the amplitudes of the fundamental frequency component $f_0$ and of the second and third harmonics $2f_0$ and $3f_0$, respectively, which are generated by block 20 of FIG. 1 are equal; they do not have the relationship illustrated by plot 410 of FIG. 4, because the relationship of plot 410 of FIG. 4 is imposed by block 30, which occurs after generation of the sinusoidal components. The general relationship is that the gain applied to a particular sinusoidal component $b^i$ of the synthesized signal, where i is 0, 1, or 2, corresponding to the fundamental, second and third harmonics, respectively, is given by $$b_i = f(f_0, i)$$

such that $b_i \geqq b_{i+1}$ at the output of block 22.

Figure 5:
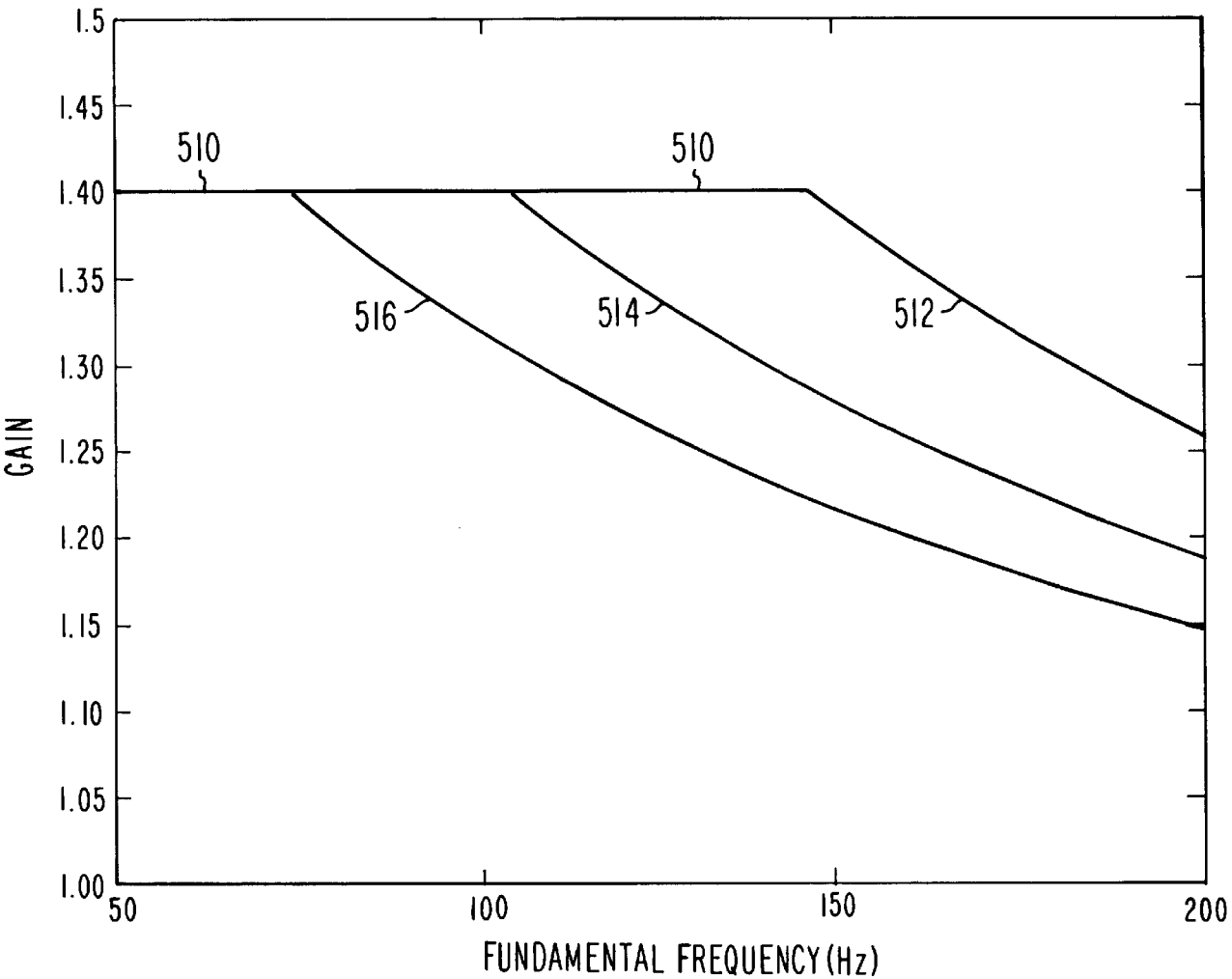
FIG. 5 plots gain applied to the fundamental component and the first and second harmonic components of the synthesized sinusoidal signals in a particular embodiment of the invention.

FIG. 5 plots the gain factors which are applied to the fundamental sinusoidal component $f_0$ and the second and third harmonic components $2f_0$ and $3f_0$, respectively, by block 22 of FIG. 1, in a preferred embodiment of the invention, which was discovered by experimentation. The equation which characterizes the plots of FIG. 5 may be stated as $$b_i = \min\,[1.4,\ (400/f_0)^{1/3+i}]$$

which is interpreted to mean that the value of $b_i$ is taken to be the lesser of the value 1.4 or the value of the function $(400/f_0)^{1/3+i}$]. More particularly, in FIG. 5, plot portion 510 represents the limiting value of 1.4. Plot portions 512, 514, and 516 represent the gain functions to be applied to the fundamental component, the second harmonic, and the third harmonic components of the sinusoidal signal, respectively. The plots of FIG. 5 are used as follows. If the frequency of the fundamental sinusoidal component is 150 Hz., the fundamental component is given a relative gain of about 1.38, the second harmonic is given a gain of about 1.27, and the third harmonic is given a gain of about 1.21; the gain applied to all other sinusoidal components is unity or 1.0. Similarly, if the frequency of the fundamental component is 125 Hz., the gain applied to the fundamental component is limited to a value of 1.4, the gain applied to the second harmonic is about 1.34, and the gain applied to the third harmonic is about 1.26. As in the previous example, the gain applied to sinusoidal components higher than the third harmonic is unity. At frequencies of the fundamental component below about 105 Hz., the gain applied to both the fundamental and second harmonic components is limited to 1.4, and all the gains are limited at frequencies of the fundamental component lying below about 75 Hz.

Other embodiments of the invention will be apparent to those skilled in the art. For example, while element 28 of FIG. 1 has been illustrated as an amplifier, those skilled in the art know that amplitude control may be effected by a controllable attenuator instead of a controllable amplifier, or that both amplification and attenuation can be used. While synthesized speech components lying near second peak frequency $f_{p2}$ have been illustrated as having lower or smaller amplitudes than those components lying near first peak frequency $f_{p1}$, they may have larger amplitudes, depending upon the characteristics of the original speech sample.

What is claimed is:

1. A vocoder system for receiving coded speech signals over a limited-bandwidth channel, said signals representing spectrum, gain, and voicing, and also representing pitch, said system comprising;

means coupled to the output of said limited-bandwidth channel for generating synthesized fundamental frequency signals and harmonics thereof in response to at least said spectrum, gain, and voicing signals; and means for selecting the relative amplitude of at least said fundamental frequency of said synthesized signal in response to the pitch period of said fundamental frequency, in such a manner that the fundamental frequency is increased in amplitude relative to at least some higher-frequency harmonics of said fundamental frequency, in inverse relationship to said fundamental frequency.

2. A vocoder system according to claim 1, further including means for selecting the relative amplitude of at least the second harmonic of said fundamental frequency of said spectrum in response to the pitch period of said fundamental frequency, in such a manner that lower pitch second-harmonic frequencies are increased in amplitude relative to at least some harmonics of said fundamental frequency at frequencies higher than the frequency of said second harmonic.

3. A method for transmitting speech signals over a bandlimited channel, said method comprising the steps of:

coding said speech signals into representations of spectrum, gain, voicing, and at least one of pitch and pitch period, to thereby generate coded speech signals;

applying said coded speech signals to an input end of said bandlimited channel, so that the coded speech signals appear at an output end of said bandlimited channel as received coded speech signals;

generating sinusoidal fundamental signals and harmonics of said fundamental signals in response to at least pitch information contained in said received coded speech signals;

generating noise signals in response to at least voicing information contained in said received coded speech signals;

combining said sinusoidal fundamental signals and harmonics of said fundamental signals with said noise signals to thereby generate synthesized speech signals in which said sinusoidal fundamental signals, said harmonics of said fundamental signals, and said noise are subject to spectral shaping in response to said spectrum component of said received coded speech signals; and increasing the amplitude of said fundamental signals relative to at least some harmonics of said fundamental signals by an amount responsive to said pitch information contained in said received coded speech signals.

4. A method according to claim 3, further comprising the step of increasing the amplitude of at least one of said harmonics of said of said fundamental signals in an amount no greater than the amount of the increase in amplitude of said fundamental signals.

5. A method according to claim 4, wherein said step of increasing the amplitude of at least one of said harmonics includes the step of increasing the amplitude of the second harmonic of said fundamental signals.

6. A method according to claim 5, further comprising the step of increasing the amplitude of the third harmonic of said fundamental signals in an amount no greater than the amount of the increase in amplitude of said second harmonic signals.

* * * * *